United States Patent [19]

Adler

[11] 4,242,004

[45] Dec. 30, 1980

[54] DOT MATRIX PRINTHEAD DRIVER

[75] Inventor: Robert Adler, Northfield, Ill.

[73] Assignee: Extel Corporation, Northbrook, Ill.

[21] Appl. No.: 22,412

[22] Filed: Mar. 21, 1979

[51] Int. Cl.[3] ..... B41J 3/10

[52] U.S. Cl. ..... 400/124; 361/159; 361/10; 335/64; 335/276; 335/279

[58] Field of Search ..... 400/124; 335/274, 276, 335/59, 64, 279, 60; 361/159, 11, 10

[56] References Cited

U.S. PATENT DOCUMENTS

| | | | |
|---|---|---|---|
| 1,554,652 | 9/1925 | Pons | 200/33 |
| 3,127,602 | 3/1964 | Russo et al. | 335/274 |
| 3,301,177 | 1/1967 | Shepard, Jr. | 101/93.33 |
| 3,386,378 | 6/1968 | Bradbury et al. | 101/93.04 |
| 3,504,623 | 4/1970 | Staller | 101/93.33 |
| 3,568,008 | 3/1971 | Janimura | 335/276 |
| 3,644,932 | 2/1977 | Wallace et al. | 361/159 |
| 3,748,613 | 7/1973 | Venker | 335/268 |
| 3,892,175 | 7/1975 | Heindke et al. | 400/124 |
| 3,991,869 | 11/1976 | Berrey | 400/124 |
| 4,000,801 | 1/1977 | Baumeister | 400/124 |
| 4,044,668 | 8/1977 | Barrus | 101/93.04 |
| 4,049,108 | 9/1977 | Giessner | 400/124 |
| 4,109,776 | 8/1978 | Ek et al. | 400/124 |

FOREIGN PATENT DOCUMENTS

| | | | |
|---|---|---|---|
| 501949 | 4/1954 | Canada | 361/11 |
| 2,629,592 | 1/1978 | Fed. Rep. of Germany | 101/93.48 |

OTHER PUBLICATIONS

Mathews, "Print Hammer Mechanism," IBM Technical Disclosure Bulletin, vol. 19, No. 9, p. 3245, 2/77.

*Primary Examiner*—William Pieprz

*Attorney, Agent, or Firm*—Kinzer, Plyer, Dorn & McEachran

[57] ABSTRACT

A driver mechanism for a dot matrix printhead, including an electromagnet, an armature, and a print impact element connected to the armature by a cantilever spring, energization of the electromagnet and consequent movement of the armature to closed position driving the impact element to impact a record sheet supported on a platen; a concentrated mass load is mounted on the spring, sufficient to maintain the impact element essentially in its rest position during a substantial portion of the armature movement so that the force/travel characteristic of the spring governs movement of the impact element, with maximum force at the outset and near zero or zero force at impact. Energization of the electromagnet is interrupted when the armature closes, and a shunt circuit holds the armature closed until just before impact.

4 Claims, 7 Drawing Figures

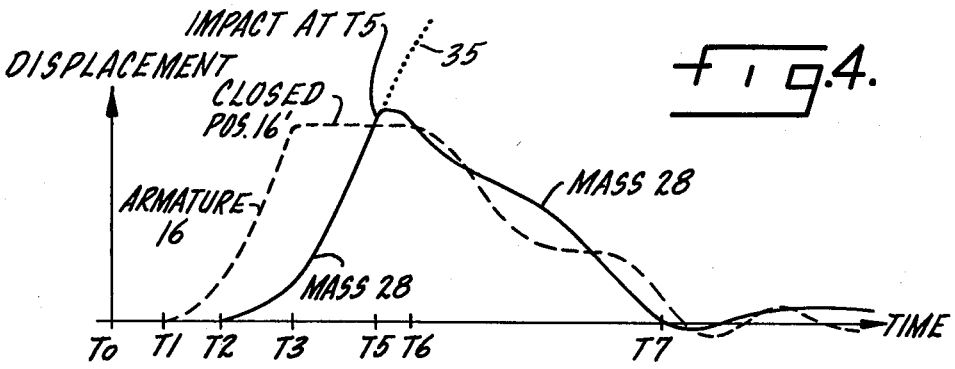
fig.4.
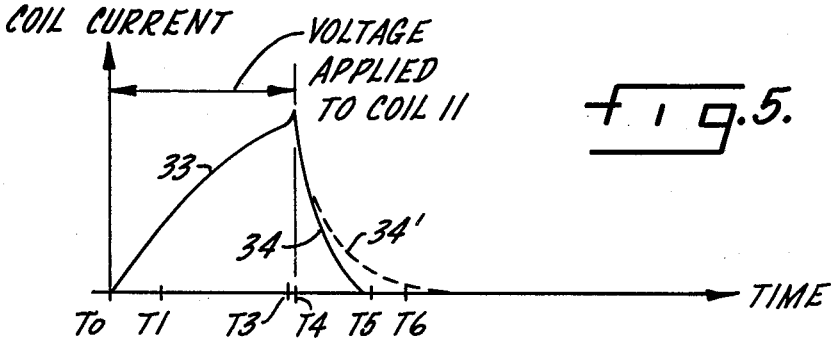
fig.5.
fig.6.
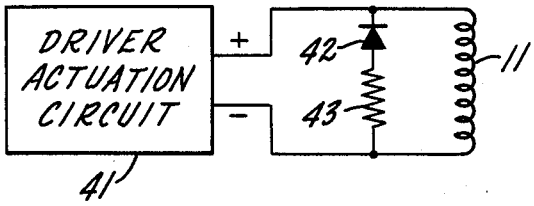
fig.7.
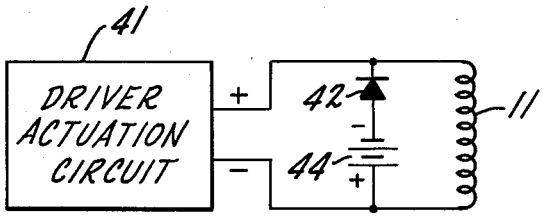

DOT MATRIX PRINTHEAD DRIVER

BACKGROUND OF THE INVENTION

The printhead of an impact-type dot matrix printer includes a plurality of individual driver mechanisms, usually one driver for each dot position in one or more columns of the matrix. The distance through which the driver moves an impact element to print a dot on a record-receiving sheet is quite small (e.g., of the order of 0.02 inch), allowing for high speed operation. in a column-sequential printer having a nominal print rate of thirty characters per second, and using a 5×7 dot matrix for each character with three blank columns between characters, for example, the maximum print rate may actually be fifty to sixty characters per second or 400 to 480 columns/second. The driver mechanism is usually an electromagnetic device of either the solenoid or clapper type, having a small air gap between two magnetizable surfaces which attract each other when the coil of the driver is energized. Electromagnetic drivers of this kind are well suited to produce the required impact force while operating over a very small stroke. An effective direct-acting solenoid driver of this general type is shown in Zenner et al U.S. Pat. No. 3,729,079.

A conventional clapper or solenoid type electromagnetic driver, however, has one important disadvantage as applied to a dot matrix printhead. The force developed by the electromagnetic driver is small at the beginning of the stroke and becomes much larger at the end of the stroke. This is precisely the opposite of the optimum force/travel characteristic. A small force at the beginning of the stroke wastes time in getting the impact element to move, and there is little or no advantage to application of a large force later when the print rod or other impact element is about to hit the paper. Ideally, a printhead driver for an impact-type dot matrix printer should develop a large force at the beginning of its stroke, for maximum acceleration, and that force should diminish as the impact element approaches the paper or other record-receiving sheet. The impact on the paper then becomes largely independent of the length of travel, allowing for a substantial tolerance for the spacing between the platen of the printer and the impact elements of the printhead.

One basic mechanism that affords a close approximation to the ideal force/travel characteristic referred to above is a spring. An impact element driven by a spring provides maximum force at the beginning of its stroke; furthermore, that force decreases approximately linearly as the print element moves toward the platen. For optimum operation, the force should become approximately zero at the point where the print rod or other impact element would strike multi-copy paper, with a reverse force coming into effect for further travel of the impact element. This affords an automatic force adjustment for the number of copies being produced, with maximum impact on relatively thick multi-copy paper but with reduced impact when the print element travels further to strike a single sheet of paper.

A force/travel characteristic of this general type is provided in some known printheads, including for example the commercially available Teletype 43 printer, and the printhead drivers described in Baumeister et al. U.S. Pat. No. 4,000,801 and Ek et al. U.S. Pat. No. 4,109,776. In the Ek and Baumeister mechanisms, the impact element for each driver is mounted on a spring that also carries a magnetic armature. The spring is normally held in a cocked position by an electromagnet that is held energized and that attracts the armature on the spring. To print a dot, the electromagnet is de-energized, releasing the spring to move toward an unflexed position, this movement constituting the print impact movement for the print rod or other element mounted on the spring. But a printhead drive of this kind is inherently inefficient as compared with one in which an electromagnet is used in a direct drive relationship to the dot impact element, because the electromagnet coil is maintained energized most of the time instead of being energized only momentarily for each print stroke. The Teletype 43 mechanism is similar but uses a permanent magnet to hold the spring in cocked position; to print a dot, an electromagnet is energized to overcome the permanent magnet flux, releasing the spring for printing movement. This results in improved energy efficiency, but the printhead is rather heavy and bulky due to the permanent magnet structure.

SUMMARY OF THE INVENTION

It is a principal object of the present invention, therefore, to provide a new and improved impact-type dot matrix printhead driver that affords maximum force at the beginning of an impact strike, the force reducing to approximately zero at the point of impact with the recording sheet, yet that is inherently energy-efficient and light in weight.

A specific object of the invention is to provide a new and improved printhead driver mechanism for an impact-type dot matrix printer, using an electromagnet driver in which efficiency of operation is improved by interrupting the drive current to the coil as soon as the motion of the electromagnet armature is completed, and controlling the rate of collapse of the magnetic field to maintain the electromagnet actuated until impact is achieved.

It is another object of the invention to provide a new and improved driver mechanism for an impact-type dot matrix printhead in which the timing of energizing signals and the mechanical parameters of the driver mechanism provide for optimum efficiency of operation without imposing unduly critical tolerance requirements, particularly in the impact element-platen spacing.

Accordingly, the invention relates to a dot matrix printhead driver comprising an electromagnet including a coil, circuit means for applying an energizing voltage to the coil, and a rigid clapper-type armature pivotally movable from a normal position to an actuated position in response to energization of the coil. The printhead driver further comprises a print impact element, movable in a print impact movement from a reset position spaced from a platen to a terminal impact position engaging a record sheet of given thickness on the platen, and a cantilever leaf spring having one end affixed to the armature, the opposite free end of the leaf spring engaging the print element for moving the print impact element from its rest position toward its terminal impact position in response to movement of the armature to its actuated position. Inertial load means is provided, aligned with and including the mass of the impact element, sufficient to maintain the impact element essentially in its rest position during a substantial portion of the movement of the armature to actuated position, so that acceleration of the print impact element during its print impact movement is governed by the force/travel characteristic of the spring, the spring characteristic being selected so that the accelerating force passes through zero at an intermediate impact position spaced from the terminal impact position by at least one additional record sheet thickness and is negative between the intermediate and terminal impact positions, the major portion of the print impact movement of the impact element occurring after the armature reaches its actuated position.

BRIEF DESCRPTION OF THE DRAWINGS

FIG. 4 illustrates the displacement characteristics of the electromagnet armature and the impact element of the driver mechanism of FIGS. 1 and 2 as a function of time;

FIG. 5 illustrates the current and voltage employed in actuation of the electromagnet, on the same time scale as FIG. 4; and FIGS. 6 and 7 are simplified electrical diagrams for energizing circuits for the printhead driver mechanisms.

DESCRIPTION OF THE PREFERRED EMBODIMENTS

Figure 1:
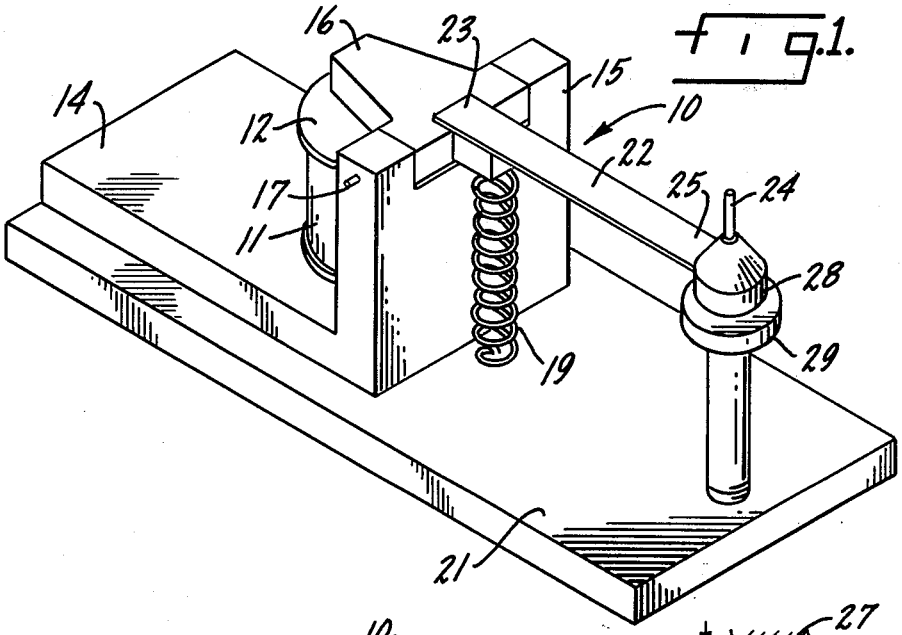
FIG. 1 is a perspective view of a printhead driver mechanism for a dot matrix printer of the impact type, constructed in accordance with one embodiment of the present invention.
Figure 2:
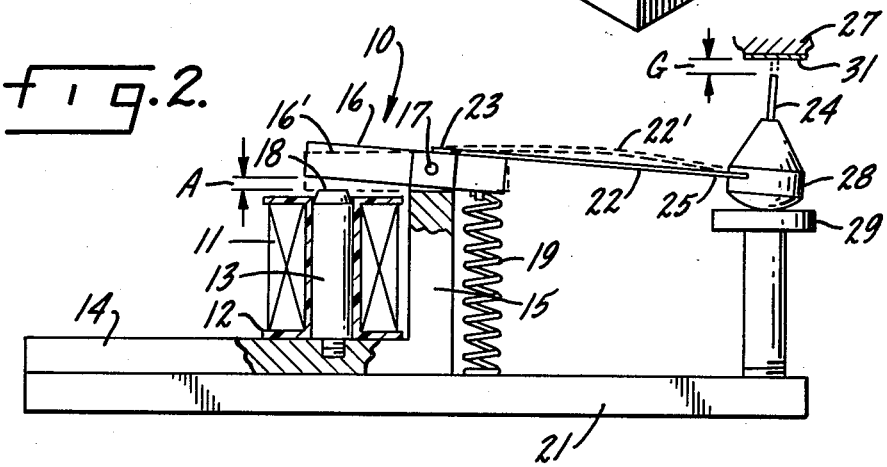
FIG. 2 is an elevation view, partly in cross section, of the printhead driver mechanism of FIG. 1.

FIGS. 1 and 2 illustrate a dot matrix printhead driver mechanism 10 constructed in accordance with one embodiment of the present invention. Driver 10 includes an electromagnet comprising a coil 11 mounted on a bobbin 12 disposed in encompassing relation to a pole piece 13 that is mounted on and extends upwardly from a base 14 of magnetic material. The magnetic base 14 includes an upwardly extending arm 15; elements 13–15 constitute the principal magnetic structure for the electromagnet of driver 10.

The electromagnet of driver 10 also includes a clapper-type armature 16 that is pivotally mounted on the upper portion of arm 15 by suitable means such as a pivot pin 17. Armature 16 extends from the top of arm 15 over the tip 18 of pole piece 13, the tip of pole piece 13 projecting slightly above the top of bobbin 12. A return spring 19 connected from armature 16 to a support base 21 normally maintains armature 16 in the position shown in solid lines in FIGS. 1 and 2, spaced from the pole piece tip 18 by a relatively small air gap A as shown in FIG. 2; a typical gap A is 0.016 inch.

Printhead driver mechanism 10 further comprises a cantilever arm 22 having one end 23 affixed to armature 16. A short print rod or impact element 24 is mounted on the free end 25 of cantilever arm 22. When armature 16 is in its normal position, as shown in solid lines in the drawings, impact element 24 is disposed in a rest position spaced from a platen 27 by a small print stroke gap G (FIG. 2). Typically, gap G may be of the order of 0.04 inch.

The cantilever arm 22 of printhead driver mechanism 10 is a leaf spring. The mounting for impact element 24, on the free end 25 of spring arm 22, constitutes a weight 28 that affords a mass load on the free end of the cantilever arm. The massload afforded by weight 28 should be sufficient to maintain impact element 24 in its rest position during a substantial portion of the closing movement of armature 16 as described more fully hereinafter. In the rest position for print impact element 24 and weight 28, the weight rests on a stop member 29. Stop member 29 is preferably formed of rubber or other resilient material.

To print a dot on a sheet of paper or other record-receiving sheet 31 on platen 27, a voltage is applied to coil 11 of driver 10. The current in the coil builds up gradually; the resulting magnetic field generated in the magnetic structure 13–16 causes armature 16 to pivot downwardly to the position indicated by dash outline 16′ in FIG. 2. The movement of armature 16 to its actuated (closed) position 16′ bends leaf spring 22, as indicated by the dash outline 22′. However, little or no movement of weight 28 and impact element 24 occurs until after armature 16 has moved a substantial part of the distance toward its actuated position 16′.

Immediately after armature 16 reaches its actuated position, the voltage to coil 11 is interrupted, but the high inductance of the closed magnetic circuit causes current to continue through the coil and through a damper diode, in either of the operating circuits (FIGS. 6 and 7). Meanwhile, impact element 24 and weight 28 begin to move toward platen 27 (FIG. 2); impact element 24 strikes the recording paper 31 at approximately the instant of maximum velocity. Impact element 24 then bounces back away from the paper, with a slight reduction in velocity as compared to its impact velocity. Clapper 16 is still in its actuated position 16′ and exerts a retarding force upon impact element 24 and weight 28, slowing the recoil movement.

At some time during the recoil period for impact element 24, the current through coil 11 decreases to a level such that armature 16 returns to its original (normal) position, being pulled away from pole tip 18 by the pivotal force applied to the armature by weight 28 acting through arm 22. The return movement of the armature 16 may also be assisted by spring 19, though in some installations that spring may be eliminated. Shortly afterward, the mechanism comes to rest in the position shown in solid lines in FIGS. 1 and 2. The resilient stop element 29 serves as a damping device, limiting bouncing of the impact element and bringing the print driver 10 rapidly into condition for the next printing operation.

As noted above, it is generally desirable for armature 16 to move to its actuated position 16′ before the mass 28 and impact element 24 have moved any substantial distance away from the rest position on stop 29. On the other hand, some compromise in this relationship may be desirable in order to minimize the total time required for a print cycle of driver 10. Experiments with driver 10 indicate that weight 28 can be reduced enough to permit some movement prior to complete closure of the armature without significant reduction in impact energy.

FIGS. 4 and 5 illustrate the operating characteristics of device 10 in a construction employing a spring arm 22 having an overall length of 0.72 inch and an active length of 0.563 inch with a mass 28 of 0.125 gram and a total effective mass for spring 22 and weight 28 of approximately 0.16 gram. With this specific construction, an impact velocity of approximately 3.5 meters per second was realized, and impact energy was found to be essentially unchanged in comparison with a corresponding structure using a substantially greater weight for mass 28, some 0.5 gram. To present a clearer picture of the relative motions of armature 16 and mass 28, these motions are shown in FIG. 4 as if they had the same amplitude. In fact, in the specific construction described, air gap A was 0.016 inch and gap G was 0.04 inch; thus, the motions of mass 28 were actually 2.5 times larger than those of armature 16.

As shown in FIG. 5, with energization of coil 11 beginning at time To, the current to coil 11 increases as shown by curve 33. Movement of armature 16 does not begin until time T1, FIG. 4. The movement of mass 28, under quite low acceleration, is initiated at the time T2. Armature 16 reaches its closed position 16' at time T3, in this instance approximately 600 microseconds. At a time T4, almost immediately after time T3, the voltage applied to coil 11 is interrupted (FIG. 5) and the current in the coil, maintained through a diode connected in parallel with the coil, begins to decay rapidly as indicated by curve 34. The impact of print element 24 with paper 31 (FIG. 2) occurs at time T5 (FIG. 4), in this instance approximately 880 microseconds. Mass 28 has returned to its rest position and device 10 is ready for a new print operation at time T7, less than 2000 microseconds. For a teleprinter required to operate at a maximum speed of 400 columns per second, the cycle time T7, being less than 2000 microseconds, is quite acceptable.

Analysis indicated that for the mechanism and conditions described above and illustrated in FIGS. 4 and 5, the potential energy stored in spring 22 at the time of armature closure, time T3, is about one-third less than if mass 28 were heavy enough to preclude movement prior to closure of the armature. However, nearly two-thirds of the reduction in potential energy is used to create additional kinetic energy for the rapidly accelerating mass 28 and impact element 24. Consequently, the computed impact velocity at time T5 is only about six percent smaller than it would be if the mass were held stationary until time T3.

To obtain the desired operating characteristics for the invention, with force at a maximum at the beginning of the print stroke of impact element 24 decreasing throughout that stroke to essentially zero at the point of impact on paper 31, mass 28 must be substantial. Otherwise, spring 22 functions as a stiff lever arm and the desired force-travel characteristic cannot be attained. On the other hand, in order to obtain a short enough operating cycle for a high speed printer, it is likely to be desirable to reduce mass 28 so that some limited displacement of the mass and impact element 24 occurs before armature 16 is completely closed.

The dots printed by driver mechanism 10 have been found to be quite acceptable in uniformity of size and appearance. Moreover, it has been found possible to vary the gap G separating impact element 24 from platen 27 (FIG. 2) over a range of as much as 0.025 inch while maintaining acceptable print quality. This broad tolerance is an important characteristic of device 10; there is no really critical requirement for precision alignment of the print impact elements and the platen, as regards gap G. Furthermore, power consumption in device 10 is only about forty percent of that for a direct-acting solenoid driver of the kind shown in Zenner U.S. Pat. No. 3,729,079. The power consumption shows even greater improvement in comparison with printhead drivers that require continuous energization of holding coils except during actual printing operations, such as the device of the Baumeister et al patent referred to above.

The dotted curve extension 35 in FIG. 4 illustrates the trajectory of weight 28 and impact element 24 and the quite limited decrease in impact velocity that occur if gap G (FIG. 2) is increased by moving platen 27 and paper 31 further away from the impact element rest position.

FIG. 6 is a simplified illustration of one form of energizing circuit that may be used for coil 11 in device 10. In this circuit, coil 11 is energized from a suitable driver actuation circuit 41, with the polarity indicated on the drawing. A diode 42 is connected in series with a damping resistor 43 across the coil. With the circuit shown in FIG. 6, after the drive voltage is cut off, the collapsing magnetic field of coil 11 induces a voltage across the coil with a polarity opposite to the original energizing voltage. This gives rise to a flow of current through diode 42, which is now forward biased, and resistor 43.

If the total damping resistance, consisting of the D.C. resistance of coil 11, the low forward resistance of diode 42, and resistor 43, is large, the time constant for decay of the coil current will be small and the current will reach a zero level well prior to the time of needle impact T5 (FIGS. 4 and 5). This is quite undesirable. On the other hand, if the total damping resistance is made as small as possible, as by omitting resistor 43, a longer and more desirable rate of decay is achieved as indicated by curve 34' in FIG. 5. In these circumstances, however, the current does not reach zero until well after the time of needle impact and the total print cycle time is unduly extended. A minimum value for resistor 43 can be identified which will insure that the armature remains closed until the time of needle impact, T5, but some undesired current then still flows after impact, using the circuit of FIG. 6.

This condition can be corrected with the modified circuit shown in FIG. 7. Here, the damping resistor 43 of FIG. 6 is replaced by a voltage source 44 connected in series with diode 42 with a polarity such as to oppose or "buck" the voltage induced across coil 11 during collapse of its magnetic field. Neglecting the resistive voltage drop in the coil, the voltage at the terminals of coil 11 during the decay period is:

$$V\ \text{coil} = L(dI/dt), \tag{1}$$

L being the inductance of coil 11. Diode 42 acts to clamp the terminal voltage of coil 11 to the voltage of source 44 as follows:

$$V\ \text{coil} = V_{44} = L(dI/dt), \tag{2}$$

Consequently, $$dI/dt = V44/L, \tag{3}$$

which may be expressed as $$I = I_o - (V44/L)t \tag{4}$$

in which $I_o$ is the initial value of decay current. It can be seen from equation (4) that the decay of the current is a linear function and reaches zero at a time T, where $$T = I_o L/V_{44}, \tag{5}$$

after the drive voltage is turned off. The magnitude of the voltage $V_{44}$ is selected to reduce the coil current to zero just before the point of printing impact. This analysis neglects the effect of resistance and the fact that the inductance L of coil 11 is not constant but depends on the flux. These factors change the details but not the character of the process. In actual practice, in a printhead including a number of drivers (usually seven or nine), the voltage source 44 may be a zener diode common to all of the driver mechanisms.

Driver actuation circuit 41 is not shown in detail, because suitable operating circuits are well known in the art. From the foregoing description, it will be apparent that the actuation circuit must energize coil 11 with a voltage pulse of defined duration just slightly longer than the time To–T3 required to close armature 16. The pulse length must be selected to fit the physical characteristics of the drive mechanism; for driver 10 that pulse length is 600 microseconds. Known driver circuits are adequate for this purpose.

It is usually undesirable to have armature 16 engage pole tip 18 in a direct contact of magnetic materials, since the armature may tend to "freeze" to the pole tip. A thin non-magnetic spacer (not shown) may be mounted on either armature 16 or pole tip 18 for this purpose, or other equivalent alternatives may be employed, leaving a minute non-magnetic gap even for the actuated position of the armature. Armature 16 has been shaped (see FIG. 1) to afford maximum cross-sectional area for magnetic flux wherever mass is not a consideration, but the shape of the armature is subject to substantial variation. In a complete printhead, where space is a premium consideration, base 14 may be materially reduced in its dimensions, particularly its width, with no adverse effect on performance.

Figure 3:
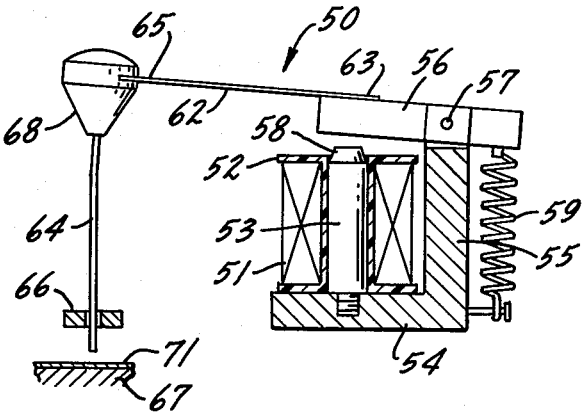
FIG. 3 is an elevation view, partly in cross section, of a printhead driver mechanism constructed in accordance with another embodiment of the invention.

FIG. 3 illustrates a printhead driver 50 constructed in accordance with another embodiment of the invention. The electromagnetic structure of device 50 is similar to that of device 10 and includes a coil 51 mounted on a bobbin 52 disposed in encompassing relation to a pole piece 53 mounted on a magnetic base 54. The magnetic base 54 includes an upwardly projecting arm 55 upon which an armature 56 is mounted by means of a pivot pin 57. A return spring 59 normally maintains armature 56 in the illustrated position, separated by a short air gap from the tip 58 of pole piece 53.

One end 63 of a cantilever spring arm 62 is affixed to armature 56. The free end 65 of spring 62 carries a weight 68 that is used as a mount for an elongated print rod 64 that constitutes the impact element for driver 50. Print rod 64 extends through a guide 66 into alignment with a platen 67 upon which a sheet of paper or other print-recording material 71 is supported.

The operation of print driver 50, FIG. 3, is essentially the same as for device 10, FIGS. 1 and 2. As before, initial movement of armature 56 toward the pole tip 58 results in the bending of spring arm 62; the movement of weight 68 and print rod 64 does not begin until there has been substantial movement of the armature. As before, when armature 56 reaches its closed position the current to coil 51 is cut off and the armature is maintained closed for a short interval by the current developed in coil 51 through the collapse of the magnetic field. The operating parameters of the device are selected so that the time of impact of print rod 64 with paper 71 coincides approximately with the reduction of current in coil 51 to zero level. Thus, the operating curves of FIGS. 4 and 5 apply, with no appreciable change, to device 50 as well as to device 10.

In the preferred embodiments of the invention described above the spring connection between the armature and the print impact element is a cantilever leaf spring and the mass load is a separate element located at the juncture of the spring and the impact element. However, the construction employed for the mass load is subject to substantial modification. For example, the impact element may be formed integrally with a heavy base constituting the mass load, or the mass load may be distributed along the length of the impact element. Indeed, the spring, the impact element, and the mass load may all be formed as one integral member. Other forms of springs (e.g. coil springs or torsion springs) can also be used, but the illustrated cantilever leaf spring construction is preferable.

The efficiency of a clapper improves with the speed at which it operates, because the induced EMF increases in relation to the IR drop. In part, the present structure owes its relatively high efficiency to the fact that a clapper armature with very little mass of its own is allowed to do its work against a spring rather than against the mass associated with the impact element. This permits the armature movement to be completed long before impact on the paper occurs.

From the foregoing description, it is seen that the present invention provides for use of the highly desirable force/travel characteristic of a spring in a printhead driver mechanism for a dot matrix printer, while at the same time retaining highly desirable energy consumption characteristics. The speed of operation of the devices of the invention is high enough to permit their use in high-speed printers, up to rates of 400–480 columns per second (50–60 characters per second assuming a $5\times7$ matrix). At the same time, the printhead driver mechanisms of the invention allow appreciable tolerance in the spacing between the impact element and the platen so that this parameter is not unduly critical. The overall power consumption for the devices is improved as compared with previously known devices, particularly those exhibiting the same desirable force/travel characteristics. Of course, it will be recognized that the printhead drivers may be mounted in different orientations than those illustrated with no basic change in operational characteristics.

I claim:

1. A dot matrix printhead driver comprising:

an electromagnet including a coil, circuit means for applying an energizing voltage to the coil, and a rigid clapper-type armature pivotally movable from a normal position to an actuated position in response to energization of the coil;

a print impact element, movable in a print impact movement from a rest position spaced from a platen to a terminal impact position engaging a record sheet of given thickness on the platen;

a cantilever leaf spring having one end affixed to the armature, the opposite free end of the leaf spring engaging the print impact element for moving the print impact element from its rest position toward its terminal impact position in response to movement of the armature to its actuated position;

and inertial load means, aligned with and including the mass of the impact element, sufficient to maintain the impact element essentially in its rest position during a substantial portion of the movement of the armature to actuated position, so that acceleration of the print impact element during its print impact movement is governed by the force/travel characteristic of the spring, the spring characteristic being selected so that the accelerating force passes through zero at an intermediate impact position spaced from the terminal impact position by at least one additional record sheet thickness and is negative between the intermediate and terminal impact positions, the major portion of the print impact movement of the impact element occurring after the armature reaches its actuated position.

2. A dot matrix printhead driver according to claim 1 in which the inertial load comprises a mass load concentrated at the point of engagement of the leaf spring with the impact element.

3. A dot matrix printhead driver according to claim 1 or claim 2, in which the circuit means cuts off the energizing voltage to the electromagnet coil approximately when or immediately after the armature reaches its actuated position, during the initial portion of the print impact movement of the impact element, and in which the circuit means includes a blocking diode, connected in a shunt circuit in parallel with the electromagnet coil, for maintaining a holding current in the coil, developed in response to collapse of the electromagnetic field of the coil, for a limited time interval after the actuating current is cut off, thereby holding the armature in its actuated position while the impact element completes its print impact movement.

4. A dot matrix printhead driver according to claim 3, in which the circuit means further includes a limited auxiliary voltage source, connected in series with the blocking diode in the shunt circuit, in bucking relation to the holding current, the auxiliary voltage source being selected to reduce the coil current to zero immediately prior to completion of the print impact movement of the impact element.

* * * * *